US005397606A

United States Patent [19]

Jeffs

[11] Patent Number: 5,397,606

[45] Date of Patent: Mar. 14, 1995

[54] ENCLOSURE FOR PAINTING AND A METHOD OF ENFORCING EVAPORATION FROM A COATING ON A PANEL SURFACE

[75] Inventor: Christopher S. Jeffs, Reading, England

[73] Assignee: Imperial Chemical Industries PLC, London, England

[21] Appl. No.: 55,012

[22] Filed: Apr. 30, 1993

[30] Foreign Application Priority Data

Apr. 30, 1992 [GB] United Kingdom ..... 9209361
Nov. 3, 1992 [GB] United Kingdom ..... 9222994

[51] Int. Cl.[6] ..... B05D 3/04

[52] U.S. Cl. ..... 427/542; 34/270; 34/666; 118/63; 118/64; 118/300; 118/326; 239/428.5; 239/DIG. 21; 427/378

[58] Field of Search ..... 118/63–64, 118/300, 309, 326; 34/243 C, 243 R, 39; 427/378, 542; 239/291, 428.5, 387.4, DIG. 21

[56] References Cited

U.S. PATENT DOCUMENTS

| | | | |
|---|---|---|---|
| 1,606,442 | 8/1923 | Nichols . | |
| 2,869,246 | 1/1959 | Buschmann et al. . | |
| 2,988,459 | 6/1961 | Buelow et al. | 118/63 X |
| 3,579,853 | 5/1971 | Martino | 34/218 |
| 3,808,703 | 5/1974 | Kamiya | 34/243 C |
| 3,948,054 | 10/1976 | Frochaux | 239/291 X |
| 3,985,302 | 10/1976 | Frochaux | 239/291 X |
| 4,257,172 | 3/1981 | Townsend | 34/39 X |
| 4,385,728 | 5/1983 | Inglis et al. | 239/DIG. 21 |
| 4,416,068 | 11/1983 | Nilsson et al. | 34/39 X |
| 4,431,135 | 2/1984 | Kay | 239/DIG. 21 |
| 4,621,187 | 11/1986 | Petro, Jr. | 118/326 X |
| 4,771,728 | 9/1988 | Bergman, Jr. | 118/642 |
| 4,817,301 | 4/1989 | Belanger et al. | 34/243 C |
| 5,068,977 | 12/1991 | Syori et al. | 34/54 |
| 5,254,763 | 9/1993 | Neikter | 34/22 |

FOREIGN PATENT DOCUMENTS

| | | |
|---|---|---|
| 205819 | 12/1986 | European Pat. Off. . |
| 261278 | 3/1988 | European Pat. Off. . |
| 370503 | 5/1990 | European Pat. Off. . |
| 401948 | 12/1990 | European Pat. Off. . |
| 420051 | 4/1991 | European Pat. Off. . |
| 426373 | 5/1991 | European Pat. Off. . |
| 8703671.1 | 8/1988 | Germany . |
| 9101810.2 | 7/1991 | Germany . |

OTHER PUBLICATIONS

B,580921, Frochaux, *Nozzle.*

*Primary Examiner*—Robert J. Warden
*Assistant Examiner*—Krisanne M. Thornton
*Attorney, Agent, or Firm*—Cushman Darby & Cushman

[57] ABSTRACT

A coating of paint on a panel is dried by directing a narrow jet of air from a supply, preferably from an air mover, held at a predetermined distance from the panel towards one edge region of the panel, the jet being substantially narrower, when it reaches the panel edge region, than the length of the panel edge and the jet being inclined to the plane of the panel such that the air from the jet is entrained by the panel in a spreading laminar flow across the panel surface from that edge region to all the other edges thereof. This induces such laminar flow over substantially the whole surface and replaces vapor-laden air closely adjacent the surface with fresh air to accelerate drying. In a painting booth for cars several such air movers use part of the bulk air flow in the booth.

16 Claims, 4 Drawing Sheets

ENCLOSURE FOR PAINTING AND A METHOD OF ENFORCING EVAPORATION FROM A COATING ON A PANEL SURFACE

FIELD OF THE INVENTION

This invention relates to the accelerated evaporation of water or other solvent from a coating on the surface of a panel, and is particularly useful for accelerating the drying of intermediate and final coats of water borne coatings for example during the re-painting of road vehicles. It also concerns a booth or other enclosure for the painting or re-painting or coating of motor vehicles and the like.

DESCRIPTION OF THE PRIOR ART

Before the advent of water-borne vehicle paints in the 1970's, all paint for vehicles was solvent-based, and was applied as a primer, then a base coat and then a top coat. The solvent generally evaporated rapidly between coats without the need for excess temperature.

Paints conventionally used in decorating motor vehicles are solvent-borne and are formulated to be applied by spraying. A spray paint is designed to have low viscosity at its point of atomisation, so that it atomises easily and to have high viscosity at the target, for example the vehicle body or body panel to prevent sagging. In solvent-borne paints this viscosity change is achieved by evaporation of solvent while the paint spray is in flight between the spray gun and the target.

When water-borne paints were first introduced into the motor industry in the early 1970's, they were designed to function on spraying in the same way as their solvent based counterparts, that is to change viscosity in flight through solvent (in this case water) evaporation between the gun and the target. However, as compared with the organic liquids employed as carrier vehicles in solvent-borne paints, water has certain unique properties. First, unlike organic solvents it is present in the atmosphere and variations in its partial pressure (that is its relative ambient humidity) alter from day to day the rate at which it will evaporate. Second, its latent heat of vaporisation is high and therefore more energy is required per unit mass to evaporate water as compared with organic solvent. In consequence, these first introduced water-borne paints had to be sprayed in carefully controlled air-conditioned environments. They were never really technically satisfactory and this led to them having to be withdrawn. The first truly effective water-borne painting system for motor vehicles is that described in EP-B-38127 and comprises a water-borne base coat-clear coat system.

Base coat clear coat systems were again introduced into the motor industry in the early 1970's in order to improve the appearance of the top coat or outer-most coat on the finished vehicle, especially for metallic effect paints. The top coat is responsible for the gloss and colour of the vehicle as well as for protecting the vehicle against weathering, scratches, stone chipping and related damage to its surface. In a conventional one-coat top coat the top coat paint has to provide all these features. A base coat-clear coat system consists of two different paints. The base coat, which is applied first is highly pigmented and provides the colour and appearance (especially the metallic effect) only, whereas the gloss and stability to weathering abrasion and stone chipping comes from the clear coat.

EP-B-38127 referred to above relies on a water-borne base coat and it overcomes the problem of the viscosity change required in a spray paint in a revolutionary way. The paints are formulated so as to be thixotropic or pseudoplastic and so relatively little or no evaporation of water is required in flight to ensure the high quality spray performance called for in car painting.

The consequence of this is that the paint film can sometimes contain relatively large levels of water. When the painting step is taking place during vehicle production, this presents little or no difficulty. The base coat resin system is sufficiently robust to allow wet-on-wet application of clear coat, that is the clear coat can be applied over the base coat after the base coat has been given very little time to dry. The whole of the top coat film is subsequently baked at a high-temperature which drives off any water and cures the film.

In motor vehicle re-spray, the position is a little different. A re-sprayed vehicle cannot be subjected to baking at the temperatures used on a vehicle production line. Damage would be caused to temperature sensitive and meltable components. Hence it is desirable to be able to remove rather more water from the base coat.

Many techniques have been devised for drying and baking motor vehicles painted with solvent-borne paint. Superficially many of these techniques might seem to be directly applicable to the drying of water-borne paints after mere routine modification. However, such is the difference in behaviour as between water-borne paints and solvent-borne paints that the outcome of apparently minor modifications on the behaviour of a water-borne system is often not at all clear. With solvent-based paints, the problem of removing solvent from painted vehicles has been addressed primarily by proposing a substantial bulk air flow through the booth containing the vehicle. For example in U.S. Pat. No. 1,606,442 (1926), a solvent-based coating is dried in an air-warmed and specially humidified booth. The coating is then hardened by cooling in a bulk air-flow.

Blowing air at water-based coatings tends to cause the formation of a skin on the outer surface which then severely limits proper loss of water from within the film. This has adverse consequences on the appearance of film, since shrinkage of the film can be uneven and flake control in metallic or mica flake containing films deteriorates.

A further disadvantage of air-blowing systems has been the disturbance of dust from adjacent surfaces, which contaminates the coating.

It is of course known, e.g. from FR-A-2029314, to heat a car chassis to a high temperature such as 200° C. during the manufacturing process, in a hot-air blown kiln, to cure a base coating, and indeed infra-red radiative heating has been proposed for accelerating secondary coatings preparatory to a top coating. Heating in this way is not only expensive for a motor vehicle re-spray process but also of course, impractical when considering drying an assembled vehicle. There is therefore a demand for a method of accelerating the drying of such a coating, or indeed of any other coating on a panel, which is energy efficient and which reduces the "flash off" time to acceptable levels, without increasing the risk of dust contamination inherent with the application of non-aqueous solvent-based coatings.

SUMMARY OF THE INVENTION

Accordingly, the present invention provides a method of forcing evaporation of a solvent such as water from a coating on a predefined surface of a panel by directing a jet of air from an air supply held at a predetermined distance from the panel towards one edge region of the panel, the jet being substantially narrower, when it reaches the panel edge region, than the length of the panel edge and the jet being inclined to the plane of the panel such that the air from the jet is entrained by the panel in a spreading, predominantly laminar flow across the panel surface over that edge region and from that edge region to all the other edges thereof, thereby inducing such laminar flow over substantially the whole surface and replacing vapor-laden air closely adjacent the surface with fresh air to accelerate drying. The use of an essentially local air supply allows the position and direction of the air jet to be controlled so as to optimise the drying effect of the air, and so as to avoid disturbing any dust which may be present on adjacent surfaces. While the flow velocity of the air jet may be 1 to 2 $ms^{-1}$ as it reaches and travels along the panel surface, there is no need to increase the usual flow rate of drying air which may be moving in bulk elsewhere, e.g. from ceiling to floor in a booth. This also avoids dust disturbance.

We have found that this method is particularly energy-efficient, and that it is surprisingly effective in drying panels such as vehicle doors and bonnets.

The invention could also be beneficial in forced evaporation from thick films such as the thick water-borne primer coatings already mentioned, provided that the trapping of water or other solvent can be overcome.

Acceleration of evaporation can be further improved, in situations where the minimising of energy consumption is not so critical, by the application of thermal energy, either by pre-heating the air which is to form the jet of air, or by using radiative heat sources such as IR panels directed at the surface of the panel to be dried.

The invention also provides a booth or other enclosure for the painting or re-painting of panelled articles such as motor vehicles, having an air inlet and an air outlet for the bulk movement of drying air over a painted article standing in the booth; and characterised by at least one supplier of air at a flow velocity substantially greater than that of the bulk movement, means for holding the supplier a predetermined position and orientation, in use, in relation to a panel of the painted article which is to be dried, such as to direct a jet of drying air towards one edge region of the panel, the air supplier being so shaped, and the flow velocity being such, that the jet is substantially narrower, when it reaches the panel edge region, than the length of the panel edge, and the air supplier being positioned such that the jet is inclined to the plane of the panel and the air from the jet is entrained by the panel in a spreading, predominantly laminar flow across the panel surface over that edge region and from that edge region to all the other edges thereof, thereby inducing such laminar flow over substantially the whole surface and replacing vapor-laden air closely adjacent the surface with fresh air to accelerate evaporation.

The preferred form of air supplier is of the "air mover" type, i.e. one which is arranged to entrain a portion of the bulk flow of air from the enclosure's inlet so as to increase the volumetric rate of flow; thus the air supplier combines the pressurised air with the bulk air flow to generate a directional outflow at the greater flow velocity.

Conveniently, the air supply is positioned at the correct predetermined distance and inclination by adjusting a supporting frame.

In order that the invention may be better understood, two embodiments will now be described, by way of example only, with reference to the accompanying drawings.

DESCRIPTION OF THE PREFERRED EMBODIMENTS

In these examples, a thin water borne base coating on a vehicle panel is dried using a relatively fast moving air stream adjacent to the coated panel. This disturbs the air close to the panel which contains high moisture levels and continually replaces it with drier air. The air temperature may be higher than that of the surrounding air, or the system may be used in conjunction with infrared heating, so as to replace the latent heat of evaporation.

Figure 1:
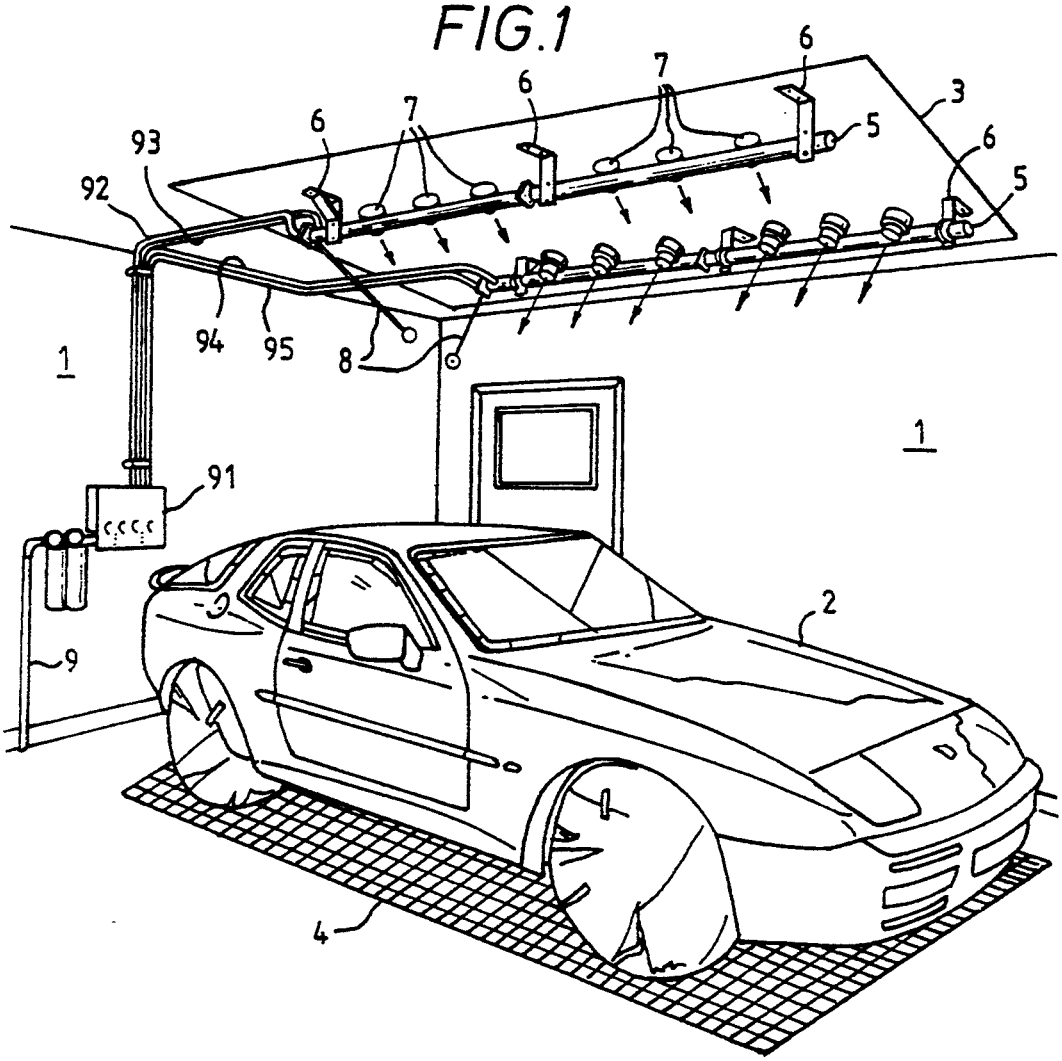
FIG. 1 is a perspective view of the interior of a re-painting booth embodying the invention, with a vehicle whose panels are to be dried.
Figure 2:
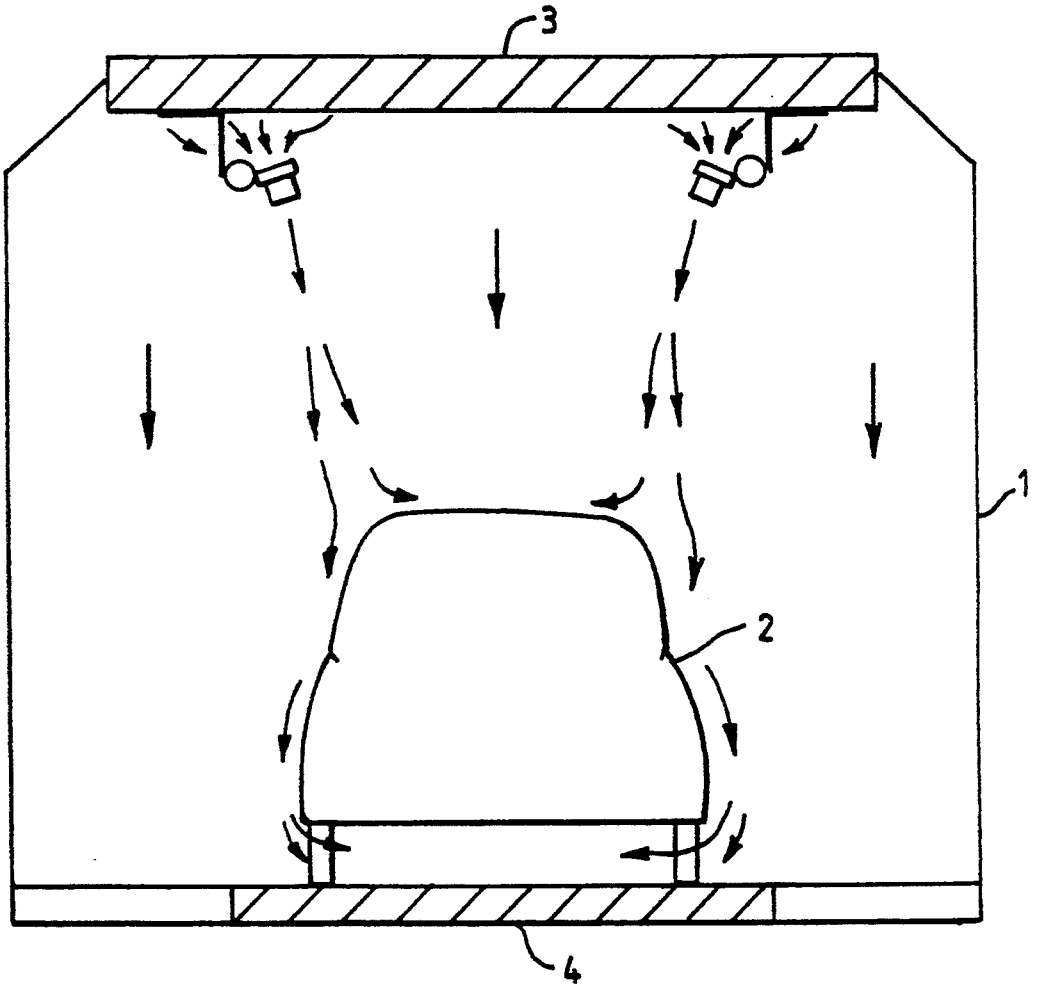
FIG. 2 is a schematic vertical section taken transversely of the car in the booth of FIG. 1.

A preferred example of drying apparatus embodying the invention is shown in FIGS. 1 and 2. A re-painting booth 1 is of conventional design with a filtered air inlet 3 in the ceiling and a grid 4 in the central region of the floor for extracting moisture-laden air. A car 2, with panels which will have been coated with paint sprayed in the booth 1, stands over the grid 4. There is a bulk flow of air generally downwards, as shown by arrows in FIG. 2, typically at 0.5 $ms^{-1}$. A pressurised air supply 9 of conventional construction has an outlet for paint-spraying (not shown).

Twelve air suppliers in the form of cylindrical air movers 7 (available commercially) are positioned adjustably, in four "zones" of three, just below the bulk air inlet 3 and within its periphery, at least 0.5 m from the outer edges of the filters. Each air mover 7 is of known construction, having an annular strip outlet, on the axis of the cylinder, for air supplied under pressure. The strip outlet is shaped such that the air is entrained along an inner wall of a hollow body of generally cylindrical shape, so that the air is made to flow axially in an annulus. This flow drags or entrains slower-moving bulk air in a cylinder from a low pressure inlet region, so as to generate a cylindrical outward flow generally along the axis. The flow is at a substantially greater velocity than the 0.5 $ms^{-1}$ velocity of the bulk flow, such that when it reaches a target panel on the car 2, after a slight divergence and slowing, it will have a velocity of between 1 and 2 $ms^{-1}$, as measured parallel to the panel surface and 0.5 to 1 cm from the surface.

The air movers 7 are fixed to two supply pipes 5 arranged parallel to one another lengthwise of the car 2 and grid 4. Each supply pipe 5 is supported for rotation about its axis by three spaced angle brackets 6 secured to the inlet 3. On each supply pipe 5, the six air movers are mutually parallel (although an air mover at each end can be inclined inwardly, to assist drying of end panels), grouped into two zones of three, on corresponding halves of the pipe. A manual lever 8 connected to the pipe 5 allows the air movers 7 to be angled appropriately. An air line 92,93,94,95 leads from an air supply control box 91 to each zone of three air movers 7 by way of a channel within the supply pipe 5.

The air supply control box 91 includes a pressure gauge and a valve for each zone. Usually, only one zone is used at any time, and the pressure is limited to 2 bar (30 p.s.i.) to give a flow rate of 425 liters (15 cubic feet) per minute. A flow restrictor is preferably provided, upstream of the valves, so that even if all four zones are active, the flow rate does not exceed 850 liters (30 cubic feet) per minute. These requirements are entirely compatible with conventional air supplies for painting booths, e.g. for two spray guns and airfed masks. The air flow from each air mover proceeds downwardly, substantially independently of its neighbouring air movers, to reach the edge of the panel, or panel portion, to which it is directed. When it reaches the panel edge its width is still substantially less than, for example 10–20% the length of that edge of the panel. If the panel is a typical car panel and is say 2 m below the air mover, the jet will typically have diverged to a width of about 10–20 cm as it impinges upon the panel. As it reaches the panel it is deflected by the panel, but is then "attached" by the panel surface and made to flow in a generally laminar curtain parallel to the panel, spreading out, along the panel edge and from that edge to other edges so as to reach the entire periphery of the panel. The phenomenon of attachment is believed to result in part from the Coanda effect. The laminar flow originating from the air mover will also tend to entrain more air from the bulk air flow reaching the panel. Examples of this air flow are shown schematically in FIG. 2.

With the benefit of air extraction from beneath the car 2, drying air is drawn around the panels facing partly or wholly downwards, so these panels can also be dried using the principles of the invention.

The air movers must be positioned and angled carefully to obtain fully the benefits described; this is explained in greater detail below.

While the booth is described as a painting booth, it should be appreciated that the booth could be used solely for drying, if required.

We have found that power consumption for the air movers is 1.8–3.6 kW for one zone, 3.0–4.8 kW for two zones, and less than 6 kW for all four zones.

The air movers need not be cylindrical, and in the example which follows they are flat having an alongate outlet. The principle of causing a laminar, divergent flow over the panel is, however, the same. Moreover, this type of air mover is also available commercially.

Figure 3:
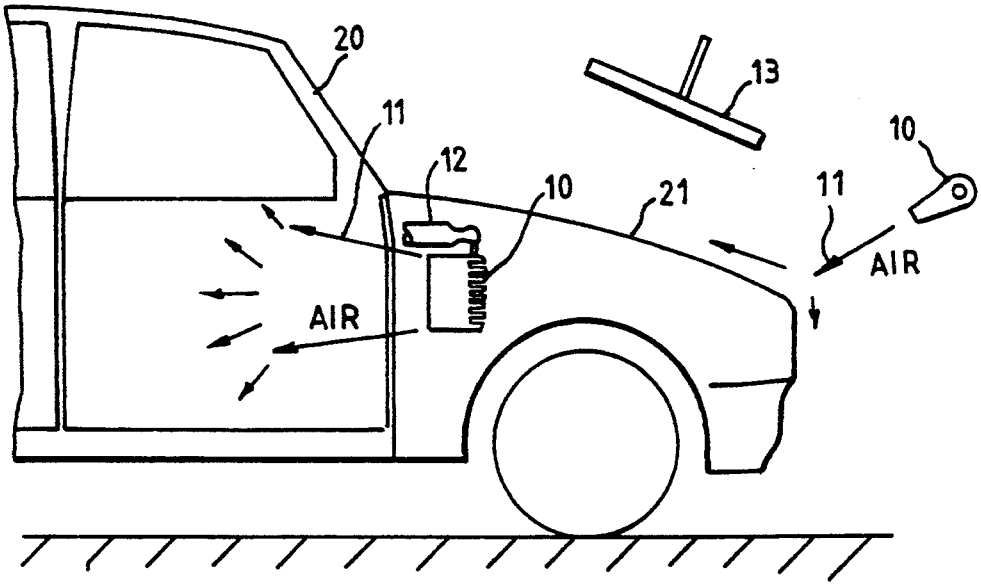
FIG. 3 is a side view of part of a vehicle in a re-painting booth, showing part of the apparatus for drying panel coatings using a second embodiment of the invention.
Figure 4:
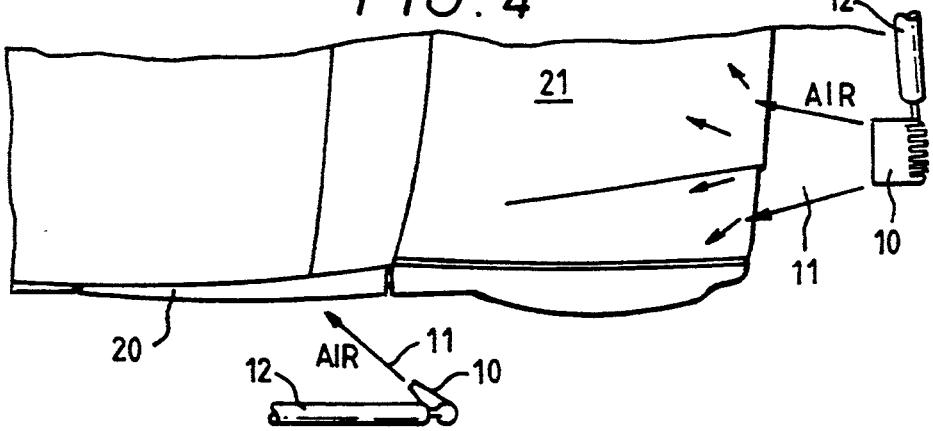
FIG. 4 is a partial plan view of the arrangement shown in FIG. 1.

As shown in FIGS. 3 and 4, a motor vehicle whose panels have been sprayed with a water borne coating is resting on the floor of a booth. The booth is ventilated in a conventional manner, with moisture laden air being extracted from the floor region.

Figure 5:
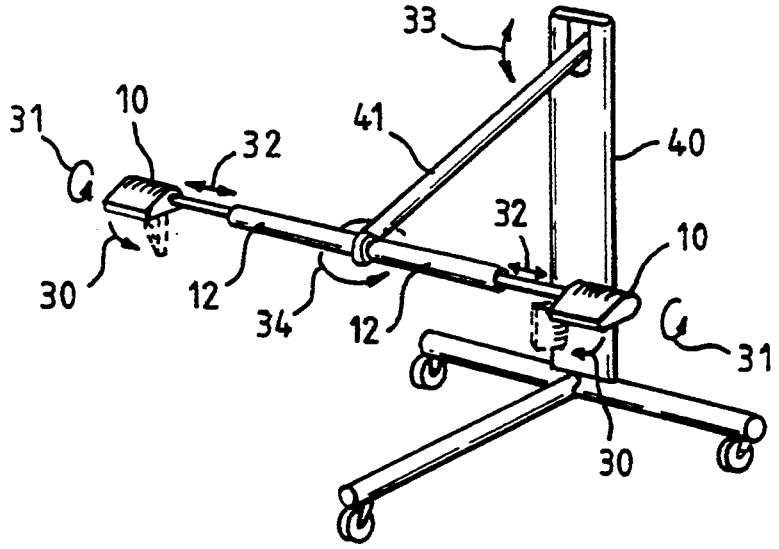
FIG. 5 is a perspective view of a support frame including two air outlets in accordance with the second embodiment of the present invention.
Figure 6:
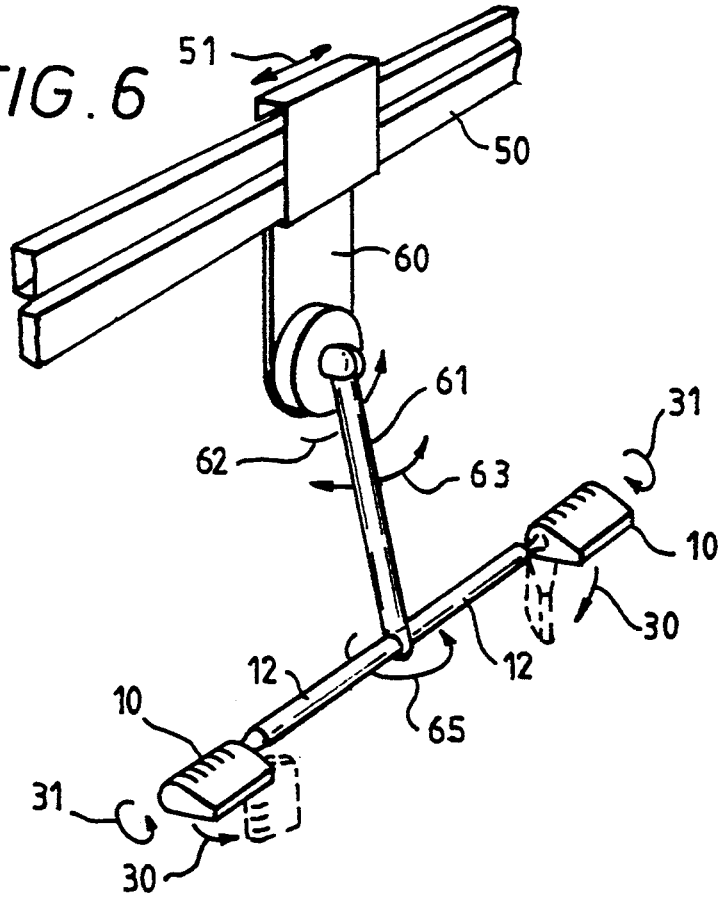
FIG. 6 is a partial perspective view of an alternative support frame together with a support rail, for use with the method of the present invention.

Pressurised air is delivered in a fan-shaped, narrow jet 11, from an air outlet 10 at each appropriate position, or from the same air outlet which is moved from position to position. The or each outlet 10 is supported adjustably on a support frame, of which examples are shown in FIGS. 5 and 6 and are described in greater detail below.

The air outlet 10, known already as a "strip air mover", produces a broad, flat band of air 11, diverging only slightly, which is directed as a jet to a portion of one edge region of the panel. Thus one air outlet is disposed adjacent the front hinge of the door panel 20 so as to distribute air over the generally rectangular major portion of the door panel. Another position for the air outlet, as shown, in order to distribute air over half of the bonnet 21, is a short distance above and to the front of the headlight. In both examples, the angle of inclination of the principal axis of the air jet 11 relative to the plane of the panel is approximately 45°, and within the range 20°–80° in any event. We have found that for more elongate panels, the outlet 10 should be inclined at a shallow angle, such as 20°–30°, to the plane of the panel, and arranged to direct the air at the shorter dimension, i.e. the width of the panel, so that the air has sufficient forward velocity parallel to the panel surface to reach the far edge of the surface.

The distance of the air outlet 10 from the nearest part of the panel surface should be about 50 cm to 60 cm or about 2 feet: any nearer, and the smooth flow is disturbed with the result that the jet fails to reach the far edges of the panel with a smooth laminar flow. Any further than this from the panel and the jet (in this particular example) would expand dimensionally and volumetrically too far to enable it still to achieve the desired result.

We have found that with careful positioning of the air outlet in relation to the panel it is possible to cause the air jet to become entrained by the panel surface and to spread over the surface with a laminar flow across the panel surface. Surprisingly, the flow of air is still substantial and reasonably uniform even at the far corners of the panel. Whilst there is no adverse effect on the quality of the coating if some portions of the panel are dried more quickly than others, the energy efficiency of the system is clearly optimised by the present arrangement which delivers a steady flow surprisingly uniformly over the panel.

The degree to which the drying process can be accelerated in this way depends to some extent on the humidity of the atmosphere. A typical period for unassisted drying, i.e. a typical flash-off time for one coat, is 10 to 30 minutes. With the air jet this can be reduced to about 5 minutes. This can if necessary be reduced further to about 1 or 2 minutes with the use of heat energy, typically using 3 kW to 6 kW power for each air outlet.

Thermal energy may be applied by preheating the air from a compressor, in a conventional manner. Alternatively, or in addition, thermal energy may be applied by radiation for example from one or more IR heating panels 13 (FIG. 3).

In this example, the air is supplied under pressure of 2 bar (30 psi) from a compressor. This input pressure is restricted to 2 bar (30 psi) by a pressure limiter, and the minimum height of the air outlet is kept to 60 cm from the floor of the booth, in order to minimise the problem of dust disturbance. Clearly, the jets should never be directed towards any surface which may collect dust.

In this example, the dimension of the air outlet is 7.5 cm long by approximately 100–125 microns wide; the air consumption rate is approximately 425 liters per minute or 15 cfm (cubic feet per minute) at 2 bar (30 psi); the velocity of air as it moves over the panel surface is between 1 and 2 meters per second and the area of coverage of the panel is approximately half a square meter.

The support frame shown in FIG. 5 consists of a wheeled trolley 40 on which is pivoted a horizontal support arm 41, pivotal as shown by arrow 33. The support arm 41 is joined to two horizontal extensions 12 to form a T structure. The arm extensions 12 are pivotable about a horizontal axis as shown by arrow 34. Each arm extension 12 is linked telescopically, as shown by arrows 32, to a further extension piece connected to an air outlet 10. The connection to the air outlet 10 also allows for pivotal adjustment, as shown by arrows 30, about a horizontal axis; each air outlet 10 is also pivotable about the axis of the support arms 12, as shown by arrows 31.

An alternative arrangement for the support frame is shown in FIG. 6. A single high level aluminium rail 50, approximately 20 cm by 5 cm in section, for example mounted on the wall of the booth, supports a sliding bracket 60, for horizontal sliding motion as shown by arrow 51. A support arm 61 is mounted by means of a universal joint on the arm 60, allowing pivotal movement about two perpendicular axes, as shown by arrows 62 and 63. The remaining components of the support frame are the same as those described above with reference to FIG. 5.

The support frame of FIG. 5 is removable from the panels being dried by means of the wheeled trolley. The support frame of FIG. 6 is retractable, either manually or automatically, along the rail to another part of the booth.

Although the invention has been illustrated by a method of accelerating the drying of a water borne coating, it is clearly applicable to other types of coating. Moreover, the invention is capable of use with panels of a wide variety of shapes: it works best with flat panels, but satisfactory results can still be achieved with less regular configurations. The important feature of the invention is that the air jet is entrained by the panel and that the flow across the panel surface is mainly laminar, and non turbulent.

The booth could incorporate a differential in the rates of bulk air flow from different regions of the ceiling, e.g. rather faster flow in a peripheral region, but even then the flow rate would be less than that of the air from the air movers (or other air suppliers).

What is claimed is:

1. A method of forcing evaporation of a solvent such as water from a coating on a predefined surface of a panel comprising directing a jet of air from an air supply held at a predetermined distance from the panel towards one edge region of the panel, the jet being substantially narrower, when it reaches the panel edge region, than the length of the panel edge and the jet being inclined to the plane of the panel such that the air from the jet is entrained by the panel in a spreading, predominantly laminar flow across the panel surface over that edge region and from that edge region to all the other edges thereof, thereby inducing such laminar flow over substantially the whole surface and replacing vapor-laden air closely adjacent the surface with fresh air to accelerate drying.

2. A method according to claim 1, in which an air outlet is positioned at the predetermined distance and at the appropriate angle of inclination by adjusting a supporting frame.

3. A method according to claim 1, in which the coating is a water borne coating.

4. A method according to claim 1, comprising using a pressurised air source to produce the jet of air, and limiting the pressure to ensure that the jet does not exceed a predetermined maximum velocity.

5. A method according to claim 1, including simultaneously thermally irradiating the panel surface.

6. A method according to claim 5, using an IR heater to irradiate the panel surface.

7. A method according to claim 1, including pre-heating the air before it emerges from the air supply.

8. A method according to claim 1, in which the panel is part of a structure resting on a support surface subject to dust accumulation, and the predetermined angle of inclination and position of the air supply is such as to avoid the disturbance of any dust on that part of the support surface in the proximity of the surface to be dried.

9. A method according to claim 1, in which the panel is part of a vehicle resting in a paint booth having an air extraction system for the vapor-laden air.

10. A method according to claim 1, in which the volumetric rate of air flow in the jet is of the order of 425 liters per minute (15 cubic feet per minute).

11. A method according to claim 1, in which the velocity of the jet of air at the panel flowing parallel to the panel is between 1 and 2 meters per second, as measured between 0.5 and 1.0 cm from the surface.

12. A method according to any preceding claim, in which the width of the jet of air in the plane of the panel as it reaches the panel edge portion is between 10% and 20% of the length of the panel edge.

13. A booth or other enclosure for the painting or re-painting of panelled articles such as motor vehicles, comprising an air inlet and an air outlet for the bulk movement of drying air over a painted article standing in the booth; at least one supplier of air at a flow velocity substantially greater than that of the bulk movement, means for holding the supplier at a predetermined position and orientation, in use, in relation to a panel of the painted article which is to be dried, to direct a jet of drying air towards one edge region of the panel, the air supplier being so shaped, and the flow velocity being such, that the jet is substantially narrower, when it reaches the panel edge region, than the length of the panel edge, and the air supplier being positioned such that the jet is inclined to the plane of the panel and the air from the jet is entrained by the panel in a spreading, predominantly laminar flow across the panel surface over that edge region and from that edge region to all the other edges thereof, thereby inducing such laminar flow over substantially the whole surface and replacing vapor-laden air closely adjacent the surface with fresh air to accelerate evaporation.

14. An enclosure according to claim 13, in which the at least one supplier of air at greater flow velocity comprises an air mover which is connected to a source of air under pressure, has a directional outlet for said air under pressure, and an inlet for a portion of bulk drying air from the enclosure's air inlet, the supplier being configured so as to cause the flow of air under pressure to entrain the portion of the bulk drying air adjacent the directional outlet.

15. An enclosure according to claim 14, in which the air mover is cylindrical and the said directional outlet being an annular strip on the axis of the air mover such that the bulk drying air in a cylindrical flow is entrained within an annular flow of the greater velocity air, along the axis.

16. An enclosure according to claim 13, in which the supplier of air is so shaped, and a source of air under pressure is such, that the air jet it produces has a width of 10–20 cm at a point 2 m from the air supplier.

* * * * *